United States Patent [19]

Magin

[11] Patent Number: 4,677,717

[45] Date of Patent: Jul. 7, 1987

[54] DEVICE FOR CONTINUOUS AND TENSION-FREE TREATMENT OF TEXTILE

[75] Inventor: Berthold Magin, Hassloch, Fed. Rep. of Germany

[73] Assignee: MTM Obermaier GmbH & Co. KG, Hassloch, Fed. Rep. of Germany

[21] Appl. No.: 658,224

[22] Filed: Oct. 5, 1984

[30] Foreign Application Priority Data

Oct. 8, 1983 [EP] European Pat. Off. ..... 83110082.1

[51] Int. Cl.[4] ..... D06L 7/02

[52] U.S. Cl. ..... 26/18.5; 34/155; 34/191

[58] Field of Search ..... 26/18.5; 34/155, 156, 34/191

[56] References Cited

U.S. PATENT DOCUMENTS

| | | | |
|---|---|---|---|
| 2,621,422 | 12/1952 | Deck | 34/158 |
| 4,121,311 | 10/1978 | Meyer | 26/18.5 X |
| 4,392,309 | 7/1983 | Schrader et al. | 34/155 X |
| 4,397,103 | 8/1983 | Ruepp | 34/155 |
| 4,505,053 | 3/1985 | Andersson et al. | 34/156 X |

FOREIGN PATENT DOCUMENTS

| | | | |
|---|---|---|---|
| 1125652 | 8/1968 | United Kingdom | 34/156 |
| 2058313 | 4/1981 | United Kingdom | 34/156 |

*Primary Examiner*—Robert R. Mackey
*Attorney, Agent, or Firm*—Toren, McGeady & Associates

[57] ABSTRACT

A device for the continuous and tension-free treatment, such as drying, shrinking, finishing and the like, of textile fabric sheets has a transport belt on which a fabric sheet is conveyed from one treatment zone to another so that the sheet is supported on the belt in a gathered condition. Upwardly directed lower nozzles are located below the transport belt and include closing members selectively opening and closing the nozzles. The nozzles extend transversely of the transport direction of the belt and are connected to a compressed air source. A baffle arrangement is associated with each nozzle and is located above the transport belt. A baffle arrangement has an upwardly extending separating wall and a generally horizontally extending perforated plate extending from the separating wall in the transport direction and inclined upwardly relative to the transport belt. Upper nozzles are located above the perforated plate for directing air downwardly through the plate against the fabric sheet supported on the transport belt. The lower nozzle can be pivoted about a vertical axis. The baffle arrangement and the upper nozzles can be tilted about a longitudinal axis spaced above the transport belt and extending in the transport direction.

9 Claims, 2 Drawing Figures

17
17
18
18
12
11
9
11
10
9
6
11
9
11
9
10
6
8
8
8
8
7
7
7
2
6'
6'
1
5
5
4
4
4
4
3
3
3
3
19
21
14
16
16

DEVICE FOR CONTINUOUS AND TENSION-FREE TREATMENT OF TEXTILE

BACKGROUND OF THE INVENTION

The present invention is directed to a device for the continuous tension-free treatment, such as drying, shrinking, finishing and the like, of textile fabric sheets so that the sheets can be lifted upwardly from a transport belt in at least one treatment zone by directing jets of air from below across the full width of the sheet. The fabric sheet is conveyed from one treatment zone to another in the transport direction in a gathered condition. At least one lower nozzle, extending transversely of the transporting direction, is located below the transport belt and is connected with a compressed air source. A closing member is arranged for selectively opening and closing the lower nozzle. A separating walls are positioned above the lower nozzle and above the transport belt and the walls extend transversely relative to the transport direction with adjacent separating walls defining a treatment zone. The lower jet extends in the upward direction and is inclined in the transporting direction by several degrees relative to the vertical. A perforated plate is located above the transport belt and is inclined upwardly relative to the transport belt in the transport direction. The perforated plate is located between two separating walls and the maximum distance between the transport belt and the perforated plate is in the range of 5 to 15 cm.

A device for the continuous treatment of textile fabric sheets is known, note German Patentschrift No. 26 44 309 corresponding to U.S. Pat. No. 4,121,311. In this known device, the fabric sheet is displaced upwardly into the air under the influence of pulse-like air jets only from below the fabric sheet whereby only the lateral extension is limited by two separating walls, but without any limitation to the height of displacement. As a result, tensile stresses are developed in the fabric sheet and they cannot be entirely eliminated when the sheet collapses after the flow of air is cut off. The shrinkage achieved in this device is completely insufficient.

A considerably improved version of this patented device is commercially available. The improvement involves the inclination of the lower nozzle in the transport direction by approximately 7.5° to 15° relative to the vertical. Further, a perforated plate is arranged inclined upwardly from the transport belt in the transport direction with the plate extending transversely across the transport direction. The perforated plate is located between separating walls and the maximum distance between the transport belt and the perforated plate is approximately 13 cm. The particular advantage in this improvement is that the upward displacement of the fabric sheet from the transport belt is limited so that tensile stresses are considerably reduced and the fabric sheet impacts with considerable force against the perforated plate or the separating walls and releases any tension stress in the fabric sheet.

Experience with this commercially available device has shown that the fabric sheets are stretched slightly during treatment. This stretching action may have several causes, for instance, the fabric sheet may be irregularly woven or knitted, it could have a velour surface, or the device may have been poorly adjusted.

SUMMARY OF THE INVENTION

Therefore, the primary object of the present invention is to provide a device of the type described above so that even though fabric sheets are stretched or have different characteristics, they can be treated without difficulty.

In accordance with the present invention, the desired result is achieved by arranging the lower nozzles to be pivotable about vertical axes.

It has been known for sometime that in this type of device the pressure of the air directed through the lower nozzles must have the most accurately defined value possible in dependence on the geometry of the lower nozzles so that the air jets discharged from the lower nozzles are directed vertically. If the air pressure is too low, the air jets are inclined toward the end of the lower nozzles. If the air pressure is too high, the air jets are inclined away from the end of the nozzles. In both cases the fabric sheet is pulled to the left or to the right. To compensate for such effects, the lower nozzles can be pivoted around a vertical axis.

In accordance with the present invention, the desired result is also achievable by the baffle plate formed between adjacent separating walls by a separating wall and a perforated plate being tiltable around an elongated axis extending in the transport direction. As a result, parts of the fabric sheet being treated can strike the superposed baffle plate sooner while other parts strike the baffle plate later as the sheet is forced upwardly by the air jets so that the disturbing influences are neutralized. With this same device, it is possible to restore the shape of fabric sheets which are stretched during treatement.

Finally, it should be noted that fabric sheets with velour surfaces have always been difficult to treat. In the present invention by pivoting the lower nozzles and tilting the baffle plate, it is possible to compensate for the non-homogeneous influences of the velour, whereby at the end of the treatment, the fabric sheet leaves the device in an optimumn treated condition.

Another feature of the present invention is the provision of upper nozzles located above the perforated plates and arranged to provide a controlled downward flow of air. The downward flow of air is determined by the perforations and inclination of the perforated plate whereby it is preferred that the flow is inclined downwardly in the transport direction. Further, the upper nozzles assure that the upper side of the fabric sheet is dried. In addition, the upper nozzles produce an air cushion so that the fabric strikes the metal of the baffle plate with a reduced impact. Finally, with the correct alignment and strength of the flow of air from the upper nozzles, the displacement of the S-strike of the fabric sheet is improved, increasing the shrinkage. The upper side of the perforated plates of the baffle arrangement is blown clean and the adjusting effect on the stretched fabric sheets is improved.

To increase the action of the device, the upper nozzles can deliver jets of air flowing counter to the lower nozzles.

The frequency of the air jets produced by the lower nozzles mounts to about 1 to 8 Hz, and preferably is in the range of 1 to 5 Hz. The shrinkage action improves with the number of air jets per unit of time.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

BREIF DESCRIPTION OF THE DRAWING

In the drawing:

FIG. 1 is a schematic representation of a cross-section taken in the transport direction through a device for treating textile fabric sheets and embodying the present invention; and FIG. 2 is a partial schematic view of the device illustrated in FIG. 1.

DETAILED DESCRIPTION OF THE INVENTION

Figure 1:
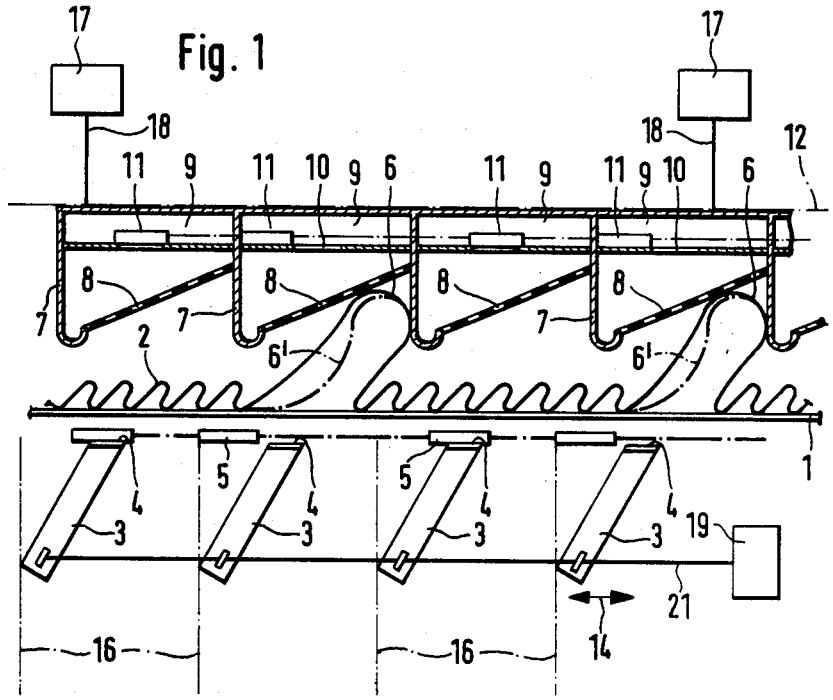

FIG. 1 shows a continuously running, endless transport belt 1 on which a fabric sheet 2 is transported in the direction from left to right in FIG. 1, passing through the device with the fabric disposed in a loosely gathered condition on the belt. Several treatment zones are located along the transport direction of the belt with each treatment zone containing an upwardly directed lower nozzle 3 with nozzle opening 4 and a closing member 5 for selectively opening and closing the nozzle opening. Means for closing and opening the closing member 5 is shown schematically as a dot-dash line connected to the closing members, note FIG. 1. In addition, each treatment zone includes a pair of upwardly extending separating walls 7 located above the belt 1 with the walls spaced apart in the transport direction and with a pair of adjacent walls forming the opposite limits of a treatment zone. Further, each separating wall has an associated perforated plate 8 located in the treatment zone and extending transversely across the transport belt. The perforated plate 8 is spaced upwardly from the transport belt 1 and is inclined upwardly in the transport direction relative to the belt, noting the inclined arrangement of the plates 8 shown in FIGS. 1 and 2. When one of the closing elements 5 opens the corresponding nozzle opening 4 of one of the lower nozzles 3, jets are directed upwardly against the transport belt and the flow of air displaces the section 6 of the fabric sheet 2 located above the nozzle upwardly so that the section 6 assumes an S-shaped configuration until the section 6 of the sheet strikes against the baffle arrangement formed by the combination of the associated separating wall and perforated plate. When the closing element closes the nozzle opening 4, the S-shaped configuration of section 6 of the fabric sheet 2 collapses (with a low frequency of the air jets, sections 6 strike the belt, with a high frequency of the air jets, sections 6 are displaced upwardly before falling) onto the transport belt. The section 6 of the sheet is moved into the next treatment zone by the transport belt and/or by the air jets.

As illustrated in FIG. 1, the closing members 5 or sliders are interconnected and are actuated by a common drive, not shown. The closing members are arranged so that only one of two adjacent lower nozzles 3 is released by the sliders or closing members 5 in the end position.

In FIG. 1, downwardly direction upper nozzles 9 having nozzle openings 10 are arranged above the perforated plates 8 and the openings can be opened or closed selectively by closing members or sliders 11. The upper closing members 11 are controlled so that a counterflow of the air jets from the nozzles 9 is effected relative to the control of the closing members 5 of the nozzles 3. It is significant that the air jets flowing downwardly from the upper nozzles 9 increase the S-shaped configuration with the fabric sheet as shown by the reference numeral 6'. In other words, with both the lower and upper nozzles directing air jets counter to one another the fabric sheet section assumes a more pronounced S-shaped configuration 6'. Moreover, an air cushion can be established in the region of the perforated plate 8 by means of the upper nozzles 9 preventing any excessive impacting force of the fabric sheet 6 against the perforated plate. Finally, aided by the upper nozzles 9, the upper sides of the perforated plates 8 are blown free of lint. The lint, along with the remainder of the air, arrives at a lint screen, not shown, usually in the substructure of the device.

In FIG. 1, a longitudinal axis 12 extending generally horizontally and in the transport direction is shown. The entire baffle arrangement, consisting of the separating walls 7, the perforated plates 8, the upper nozzles 9 with the nozzle openings 10 and the closing members 11, can be tilted by tilting means 17,18 about the longitudinal axis 12 (as illustrated by double headed arrow 15 in FIG. 2) to compensate any influences which tend to stretch the fabric sheet.

Figure 2:
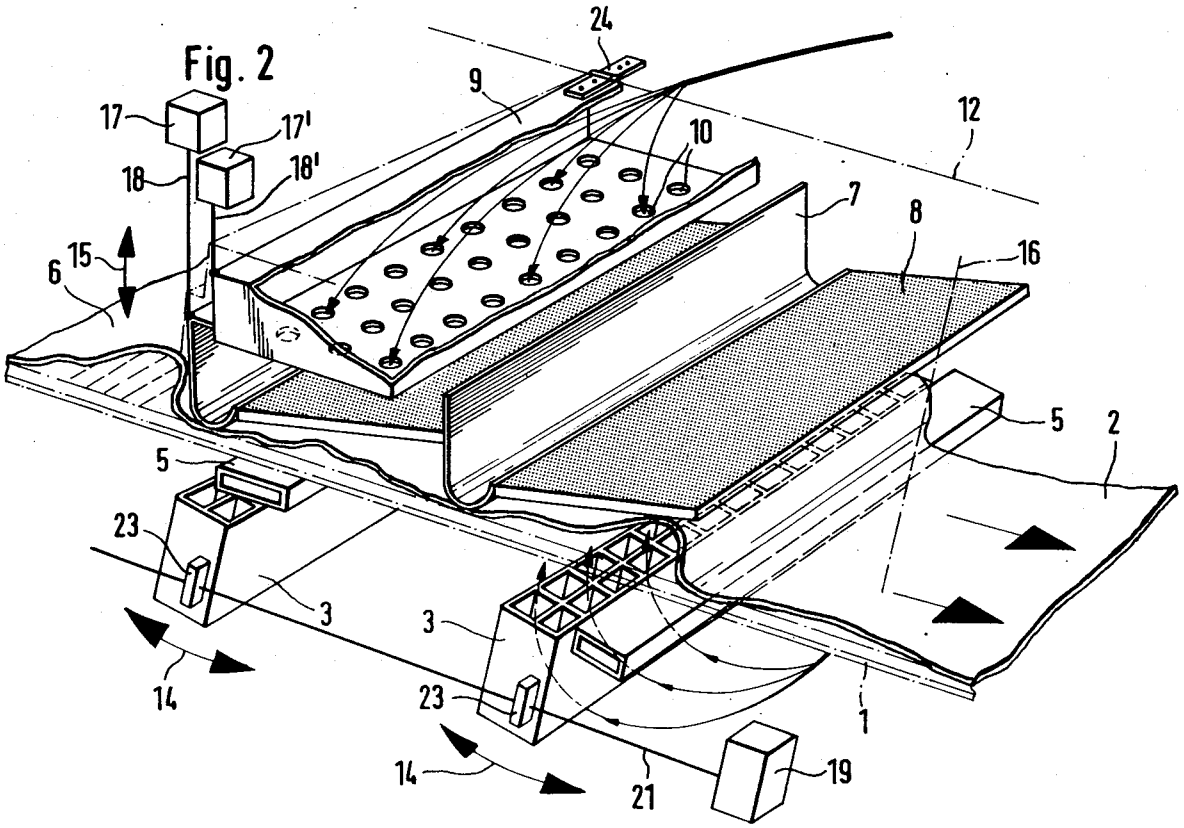

In FIG. 2, a perspective view of the device in FIG. 1 is provided with the baffle plate arrangement 7, 8 partially removed and partially exposed. Only two lower nozzles 3 are illustrated each with a closing member 5. Each nozzle 3 is shown with a double headed arrow 14 at one end indicating the pivotal direction of the lower nozzles about a vertical axis 16, that is, a vertical axis for each nozzle. The nozzles may be pivoted individually or as a group by pivoting means 19,21,22 and 23. By pivoting lower nozzles 3, one side of the fabric sheet will be directed against the baffle plate arrangement 7, 8 before the other side is displaced by the air jets, thereby producing a shrinkage on one side different from that on the other side.

The nozzle opening 4 of the lower nozzle 3 is inclined by approximately 7.5° relative to the vertical in the transport direction and the distance between the transport belt and the superposed perforated plate is a maximum of approximately 13 cm. Generally, the distance between the belt 1 and the perforated plate 8 must be selected to be less than the maximum if the inclination of the lower nozzles 3 relative to the vertical is increased.

While specific embodiments of the invention have been shown and described in detail to illustrate the application of the inventive principles, it will be understood that the invention may be embodied otherwise without departing from such principles.

I claim:

1. Device for the continuous and tension-free treatment, such as drying, shrinking, finishing and the like, of textile fabric sheets, comprising a generally horizontally arranged transport belt having an elongated direction and a width direction extending transversely of the elongated direction for transporting an elongated fabric sheet in the transport direction corresponding to the elongated direction of said belt with the width of the fabric sheet supported on said belt in the width dimension, said transport belt having an upper side on which the fabric sheet is supported and an opposite lower side and a pair of opposite side edges spaced apart in the width direction and extending in the elongated direction, at least one lower nozzle located below the lower side of said transport belt and extending across in the width direction of said transport belt and arranged to direct air against the transpot belt so that the air passes through said belt into contact with the fabric sheet supported thereon, said at least one lower nozzle having a nozzle opening directed generally upwardly toward and extending across in the width direction of said transport belt, said at least one lower nozzle extends generally upwardly and is inclined in the transport direction relative to the vertical by a slight angle, a closing member associated with said at least one lower nozzle for selectively opening and closing said nozzle opening, generally vertically extending separating walls located above the upper side of said transport belt and extending across the width of said transport belt transversely of the transport direction, said separating walls being spaced apart in the transport direction and an adjacent pair of said separating walls defining a treatment zone extending therebetween in the elongated direction and in the width direction of said transport belt and with said at least one lower nozzle located aligned below said treatment zone, a perforated plate located above said transport belt and extending between a pair of adjacent said separating walls forming the treatment zone therebetween, said perforated plate extending in the width direction and in the elongated direction of said transport belt from adjacent the lower end of the upstream one of said pair of separating walls to the downwstream one of said pair of separating walls whereby said perforated plate is inclined upwardly in the transport direction with the maximum vertical spacing between the upper side of said transport belt and said perforated plate being in the range of 5 to 15 cm, and said at least one lower nozzle has a vertical axis located between and spaced from the side edges of said transport belt and said lower nozzle is pivotable generally horizontally about the vertical axis so that said lower nozzle can be selectively oriented obliquely or perpendicularly to the transport direction whereby said lower nozzle can direct air upwardly through said transport belt for lifting the fabric upwardly toward said perforated plate from said transport belt with the fabric being lifted obliquely or perpendicularly in accordance with the selective orientation of said lower nozzle about the vertical axis, said pair of separating walls and said perforated plate form a baffle arrangement, said baffle arrangement having a generally horizontally arranged tilting axis extending in the transport direction and spaced inwardly from the side edges of said transport belt so that said baffle arrangement can be tilted about said tilting axis for varying the vertical spacing across the width of said baffle arrangement above said transport belt to compensate for any influences tending to stretch the fabric sheet.

2. Device, as set forth in claim 1, wherein an upper nozzle is located above said perforated plate extending in the width and elongated direction of said transport belt and has a nozzle opening extending across the width of said perforated plate and directed downwardly toward said perforated plate, said upper nozzle arranged to direct air through said perforated plate against the fabric sheet transported on said transport belt.

3. Device, as set forth in claim 2, wherein said nozzle opening of said upper nozzle is oriented counter to said nozzle opening of said lower nozzle, a closing member is associated with said upper nozzle for selectively opening the nozzle opening, and said closing member for said lower nozzle for effecting counter-directed flows of air from the nozzle openings of said upper and lower nozzles.

4. Device, as set forth in claim 4, wherein the frequency of the air jet directed from said lower nozzle opening and said upper nozzle opening is in the range of 1 to 8 Hz.

5. Device, as set forth in claim 4, wherein the frequency of the air jet is in the range of 1 to 5 Hz.

6. Device, as set forth in claim 2, wherein said upper nozzle is connected to said baffle arrangement so that said baffle arrangement and upper nozzle can be tilted as a unit about the tilting axis.

7. Device, as set forth in claim 2, wherein said upper nozzle is arranged to be tilted about the tilting axis so that said upperr nozzle and said baffle arrangement can be tiltably displaced separately from one another.

8. Device, as set forth in claim 7, wherein the frequency of the air jet produced from the nozzle opening of said lower nozzle is in the range of 1 to 5 Hz.

9. Device, as set forth in claim 1, wherein the frequency of the air jet produced from the nozzle opening of said lower nozzle is in the range of 1 to 8 Hz.

* * * * *

UNITED STATES PATENT AND TRADEMARK OFFICE

CERTIFICATE OF CORRECTION

PATENT NO. : 4,677,717

DATED : July 7, 1987

INVENTOR(S) : Berthold Magin

It is certified that error appears in the above-identified patent and that said Letters Patent is hereby corrected as shown below:

In the heading of the Patent, it should read:

--[54] DEVICE FOR CONTINUOUS AND TENSION-FREE TREATMENT OF TEXTILE FABRIC SHEETS

Signed and Sealed this

Fifteenth Day of December, 1987

*Attest:*

DONALD J. QUIGG

*Attesting Officer*

*Commissioner of Patents and Trademarks*